United States Patent [19]

Corse

[11] 4,214,524

[45] Jul. 29, 1980

[54] SYSTEM FOR COMPENSATING FOR ERRORS IN REGISTRATION BETWEEN COLORS PRINTED IN MULTI-COLOR PRINTING MACHINE

[75] Inventor: Louis G. Corse, Chaumont-sur-Tharonne, France

[73] Assignee: Machines Chambon S.A., Orleans, France

[21] Appl. No.: 936,198

[22] Filed: Aug. 24, 1978

Related U.S. Application Data

[63] Continuation of Ser. No. 710,205, Jul. 30, 1976, abandoned.

[30] Foreign Application Priority Data

Aug. 8, 1975 [FR] France ..... 75 24771

[51] Int. Cl.[2] ..... B41F 5/06; B41F 5/16

[52] U.S. Cl. ..... 101/181; 101/228; 101/DIG. 21; 226/28; 226/44

[58] Field of Search ..... 101/181, 248, 219, DIG. 21, 101/178–180, 182, 220–225, 226–228, 138, 139; 226/24, 25, 27–31, 42, 44, 2; 318/6; 235/92 MP; 73/95.5

[56] References Cited

U.S. PATENT DOCUMENTS

| | | | |
|---|---|---|---|
| 3,283,982 | 11/1966 | Haskin, Jr. | 226/195 |
| 3,326,436 | 6/1967 | Huck | 226/44 |

*Primary Examiner*—J. Reed Fisher

*Attorney, Agent, or Firm*—Robert E. Burns; Emmanuel J. Lobato; Bruce L. Adams

[57] ABSTRACT

A multi-color printing machine having a plurality of printing units is provided with means for compensating for errors in color registration, for example a device for varying the length of web between one unit and the next, and at least one device for preventing the tension in the web from exceeding an upper limit or falling below a lower limit.

4 Claims, 8 Drawing Figures

SYSTEM FOR COMPENSATING FOR ERRORS IN REGISTRATION BETWEEN COLORS PRINTED IN MULTI-COLOR PRINTING MACHINE

This is a continuation of application Ser. No. 710,205, filed July 30, 1976 and now abandoned.

BACKGROUND OF THE INVENTION

The present invention relates to a system for compensating for errors in registration between colours printed in a multi-colour printing machine.

In a conventional printing machine, colour registration can be ensured in two different ways, depending upon the design of the machine:

(1) The machine is equipped between two successive printing units with a registering or web length compensating device including a roll around which the web is looped and whose position can be adjusted in order to increase or reduce the length of web extending between the two successive printing units being considered;

(2) the machine is equipped with a differential device associated with the driving mechanism of the printing cylinder of one printing unit, so that compensation is achieved by varying the angular position of the printing cylinder of one printing unit in relation to the previous or succeeding one.

In both cases, when compensation is effected, the tension in the web is altered positively or negatively, according to the sense of compensation. Under normal operating conditions, the web is subjected to an equilibrium tension To, which is dependent upon the dimensions of the printing cylinder, on the tautness of the material forming the web and on the tension of the web at the inlet of the machine. After the tension of the web has been modified during the compensating action, it returns to the equilibrium tension To, in accordance with an exponential law, where the printed material is such that deformations are proportional to constraints.

If one considers a conventional machine in which colour registration is ensured using a registration or web length compensating device and if the devices for reading reference marks carried by the web and associated with various colours detect an error in registration between two colours applied by two successive printing units which is equal to one unit of length, a control unit transmits an order to move the roll of the registering or length compensating device by a distance equal to ½ the unit of length, in order to increase or reduce the length of the web between the two printing units by one unit of length. The resulting unit variation in length produces a variation x in the tension of the cloth such that $x=K1/L$, K being the tautness of the web material and L the length of web between the two printing cylinders. The instantaneous value which the tension of the web assumes is therefore equal to $To \pm x$, which must always be between an upper tension limit TM and a lower tension limit Tm. Theoretically, the lower tension limit is O, but in practice one cannot fall below a finite lower tension limit, for reasons of behaviour of the web, particularly as a result of the passive resistance of the return cylinders of the machine. TM, defining the upper tension limit corresponds substantially to the elastic limit of the web, because if the elastic limit is exceeded the web undergoes permanent elongation, which brings with it two principal disadvantages, that is to say on the one hand, the finished printed product does not have the correct length, and on the other hand, the elongated portion which appears during the running of the machine is liable not to have sufficient tautness to ensure tension of the web and guidance of it in the machine. Certain traditional web materials (paper, cardboard, plastic or thick aluminium film, for example), possess a sufficiently high elastic limit for TM to be very much above zero, and therefore registration compensations of normal amplitude are possible.

On the other hand, materials which herein will be referred to as light materials, such as a thin aluminium or polyurethane films, for example, have an elastic limit not greatly above zero tension. There thus remains a small margin in which to carry out registration compensation, and the permissible amplitude becomes incompatible with industrial use of the machine.

SUMMARY OF THE INVENTION

The object of the present invention is to provide a system permitting compensation to be made for errors in registration in a machine printing on webs of light material, the amount of compensation being compatible with the industrial running of the machine, and this by particularly simple mechanical means having effect instantaneously as soon as the tension of the web tends to assume a value which lies beyond either of the two tension limits TM and Tm.

To this end there is provided a system for ensuring the registration of colours in a multi-colour printing machine including successive printing units through which the web passes, comprising compensating means for adjusting the location on the web at which one printing unit operates, a reading device for monitoring reference marks associated with the various colours, an electronic adjustment device, a servomotor controlling the compensating means in order to carry out compensation for registration errors and means of limiting the tension in the web between two upper and lower limits, said means having effect only if the variation in tension of the web introduced by compensation for registration errors tends to assume a value beyond the range of values between the two limits, said means for limiting the tension including at least one movable device which is supported against a stop whilst the tension of the web is between the upper and lower limits, the device being moved from this stop as soon as the tension in the web leaves the range between the two limits and thus exerting a force on the web which is equal to the upper threshold or lower threshold of the tension, according to the direction of its movement.

The system provided by the invention has the advantage that if the compensation is sufficiently large to cause the tension to exceed the upper limit TM or fall below the lower limit Tm, the web is given an imaginary elasticity which enables it to be lengthened or shortened, without the actual tension of the web exceeding the limit value TM or Tm.

If compensation which has to be carried out at a given moment induces in the web a variation in tension such that the actual tension of the web lies between the limits, TM and Tm, the device does not react, and a return to the equilibrium tension is effected naturally, in accordance with the exponential law.

DESCRIPTION OF PREFERRED EMBODIMENTS

Figure 1:
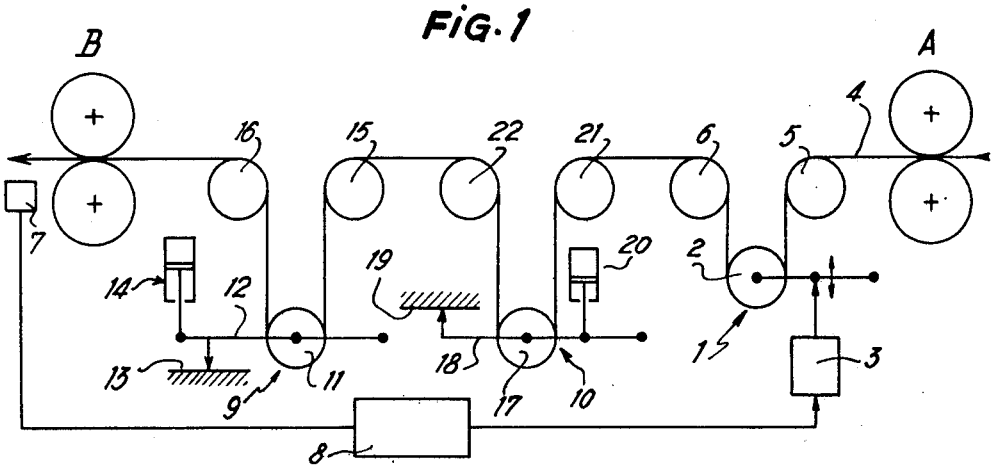
FIG. 1 is a diagrammatic side elevation of a two-colour printing machine embodying the present invention.

The principle behind the present invention will first be described with reference to FIG. 1. Referring to this figure, a two colour printing machine for use with a web of light material, for example a film of aluminium or polyurethane comprises two printing units A and B, each of which is adapted to print a respective colour on the web. The machine is equipped with registering devices 1 located between the two printing units for varying the length of web which extends between them, in order to compensate for errors in register in the images printed by the two units. The registering device 1 comprises a roll 2 which is movable vertically under the control of a motor 3. The web 4 is led to the roll 1 over a deflecting roll 5 and is restored to its original path by a roll 6 parallel to the roll 5.

At each printing unit reference marks are applied to the web and a reading device 7 is used to compare the relative positions of these marks to determine the sign and magnitude of any error in register between the two units. An electronic control device 8 responds to a signal from the reading device to cause the motor 3 to raise or lower the roll 1 in order to reduce or increase the length of the web, as may be required, to eliminate the error. A variation in tension is therefore produced.

To ensure that the tension in the web lies between the permitted upper and lower limits TM and Tm respectively, taking into account the material being considered, the machine includes two devices, each of which introduces a correction if the tension passes a respective limit.

The correcting device 9 comprises a roll 11 rotatably mounted on a vertically movable support 12 which may be pivotable as shown, or alternatively may be bodily movable. The support 12 normally bears against a fixed stop 13 and is biased downwards by a substantially frictionless ram 14 so that the loading of the roll and its support is in effect increased by the action of the ram.

The force applied by the ram 14 is arranged to be such that the resultant downwards movement applied by the roll 11 will be balanced by the tension TM of the web 4, TM being the maximum permissible tension for the material being printed. The web 4 is passed to the roll 11 around two deflecting rolls 15 and 16, so that the web is formed into a loop. The device 10 is similar, and comprises a roll 17 rotatably mounted on a vertically movable support 18, upwards movement of which is limited by a stop 19, against which it normally bears under the action of the tension in the web. The support 18 is pressed downwards by a ram 20. The force applied by the ram 20 is such that the resultant downwards movement applied to the roll will be balanced by the tension Tm of the web, Tm being the minimum permissible tension for the material. The web 4 is passed over two upper deflecting rolls 21 and 22, in order to form a loop on which the roll 17 acts.

If the actual tension in the web exceeds the minimum limit Tm, the support 18 bears against the stop 19. If, however, the tension falls below Tm, the support 18 descends, and brings about an elongation in the length of the web, and so maintains the tension at least equal to Tm. Possible movement of the support 18 downwards is calculated in relation to the greatest correction normally permitted on the machine. The first device 9 acts in the opposite direction, so that while the actual tension in the web remains lower than TM, the support 12 remains in contact with the stop 13. If the actual tension tends to exceed the value TM, the support 12 lifts from the stop 13 and allows the web to shorten while preventing the tension exceeding TM. Possible upwards movement of the support 12 likewise depends upon the greatest correction normally permitted on the machine.

It can be seen from the preceding that the roll 2 of the registering or length compensating device 1 is permitted to move a considerable distance, which is, however, limited by the maximum movement permitted to the rolls of the correcting devices 9 and 10, without the tension of the web leaving the range of values between TM and Tm.

If the supports of one of the devices 9 or 10 has left its respective stop 13 or 19, the return of the system to the equilibrium position is effected in two ways.

Figure 2:
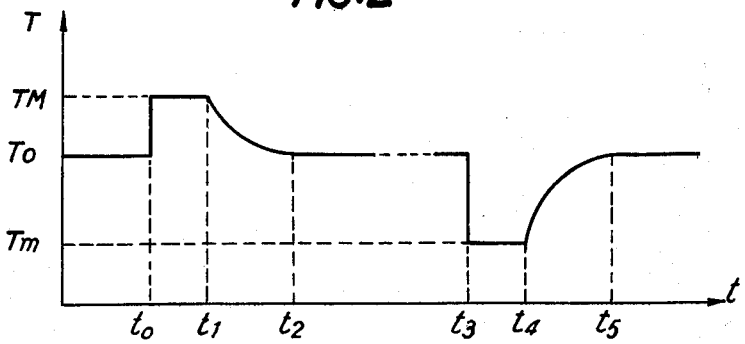
FIG. 2 is a diagram to illustrate how the tension in the web passing through the machine shown in FIG. 1 is varied.

In the first, the support of the device 9 or 10 returns to its stop in accordance with a linear law in relation to the time, at a speed which is proportional to the movement TM-To, in the case of the device 9, or proportional to To-Tm in the case of the device 10, To being the equilibrium tension of the web. This is illustrated in the diagram of FIG. 2 which gives the variation of the tension T of the web in relation to the time t. At the moment $t_o$, when a correction signal is supplied to actuate the motor 3 to adjust the roll 2 in the sense of shortening the web, the tension $T_o$ of the latter increases but is nevertheless maintained lower than the value TM because of the influence of the device 9. During the time interval $t_o$, $t_1$, the support of device 9 returns to its stop 13, and then the tension T decreases exponentially from its value TM to the equilibrium value $T_o$ within the time interval $t_1$, $t_2$, clearly equal to $3\tau$, $\tau$ being the time constant equal to the time taken by an element of the web to travel from the printing unit A to the printing unit B.

The diagram of FIG. 2 likewise illustrates at the moments of time $t_3$, $t_4$ and $t_5$ a correction of the opposite sense, resulting in a reduction in the tension T to the lower limit Tm and an exponential return to the equilibrium value $T_o$.

FIG. 1 shows an embodiment in which the devices 1, 9 and 10 are separate. It is, however, possible to adopt alternative arrangements in order to simplify the system and adapt it to the geometry of the machine in which it is incorporated. In the modification shown in FIG. 3, the upper deflecting rolls 15, 16, 21 and 22 are omitted and the connecting device 10 is arranged above the connecting device 9, the web being deflected substantially vertically downwards by the roll 17 of the device 10 to enable it to pass around the roll 11 of the device 9. In this case, the ram 20*a* of the device 10 acts upwards, and the resulting movement, taking into account the weight of the roll and its support, acts upwards.

The support of the device 9 leaves its stop 13 as soon as the tension in the web exceeds the maximum limit TM, and in the same way the support of the device 10 leaves its stop 19 as soon as the tension in the web falls below the minimal limit Tm. In this case, the movement of the parts of the two devices is always in the same direction, that is to say, upwards, away from their stops.

Figure 3:
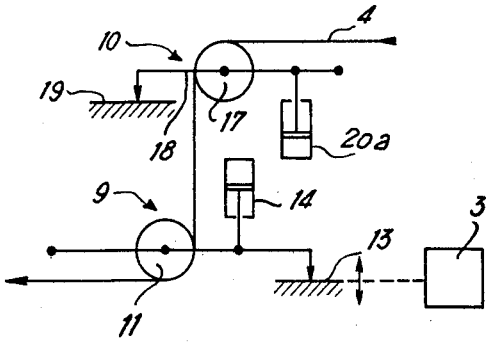
FIG. 3 is a diagrammatic side elevation showing part of a modified machine having a reduced number of return rolls.

In this type of embodiment of the invention, compensation for errors in registration can be produced by moving one of the stops vertically, for example, by moving the stop 13 using the motor 3, as indicated in FIG. 3. In this particular case, the movement of the stop 13, which is necessary in order to correct a variation of one unit of length of the web will be of the same magnitude, i.e. equal to one unit of length, whereas in the case of FIG. 1 movement of the roll 2 of the compensating device by one-half unit of length is necessary.

In practice, the devices 9 and 10 are as light as possible in order to avoid excess pressures of the web as a result of the effects of inertia.

The system which has just been described may be applied with modification to a rotary printer in which registration of the images is controlled by a differential device in the mechanism for driving the printing unit B in order to make it possible to vary the angular position of the printing cylinder of the latter in relation to that of the printing unit A. In this case, the motor 3 is used to drive the differential device. In this latter case, the stops 13 and 19 of the device represented in FIG. 3 would naturally be fixed stops.

Figure 4:
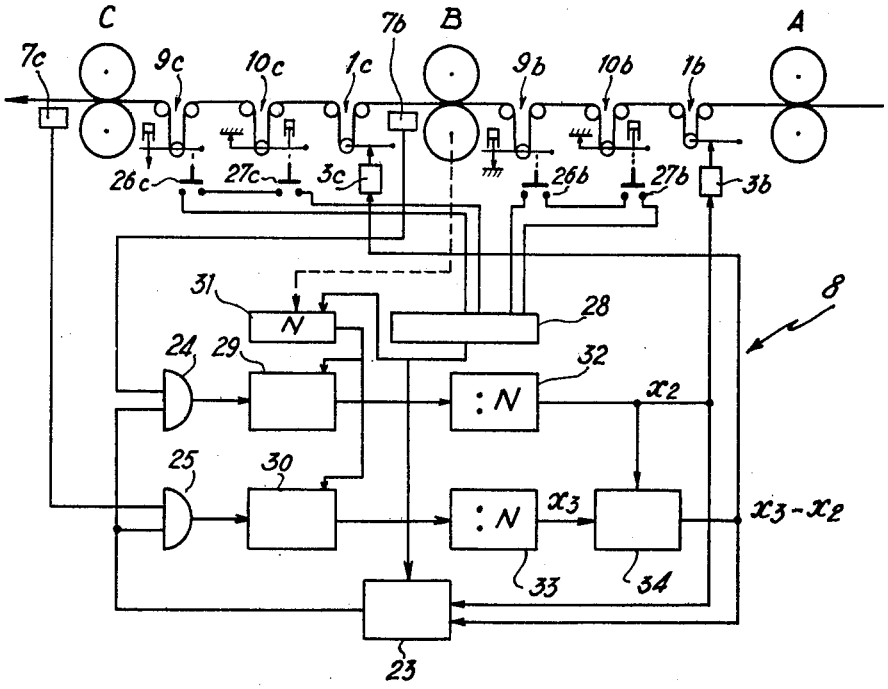
FIG. 4 is a diagrammatic side elevation of a three-colour printing machine and also shows a block diagram of an electronic adjusting device used therein.

The electronic control device which has been indicated generally at 8 in FIG. 1 will now be described by way of example, more especially with reference to FIG. 4. This device is associated with reading devices detecting errors in registration which are associated with the n-1 printing appliances following the first. In the case of the printing machine illustrated in FIG. 4, which comprises in succession three printing units A, B and C, two reading devices for detecting errors in registration are provided, that is to say, the reading device **7*b* associated with the second printing unit B and the reading device 7*c* associated with the third printing unit C. The reading devices are places slightly lower in relation to the printing units and are adapted to respond to lack of coincidence between reference marks on the web, associated with the various colours. These devices 7*b* and 7*c*, which compare the positions of the registration marks applied by the n-1 printing units with the marks applied by the first printing unit are connected to the control device 8, which transmits signals to the motors 3*b* and 3*c*** respectively of the registering or compensating devices, causing the length of the web between the printing units A and B on the one hand, and between the printing units B and C on the other hand, to vary.

Supposing that at a moment $t_o$, the reading device detects an error and signals it to the control device 8, which supplies a correction signal $x_2$ to the motor **3*b* of the registering or compensating device 1*b* to require it to compensate for the error by varying the length of web between the printing units A and B. The signal $x_2$ is likewise given to a blocking circuit 23 whose output is connected to the trigger input of two NAND gates 24 and 25, each of which has an information input connected to the reading device 7*b* in the case of gate 24 and to the reading unit 7*c* in the case of the gate 25. The gates 24 and 25** are then blocked, which thus interrupts the reading of faults.

Following the correction signal $x_2$ given to the motor **3*b* of the registering length compensating device 1*b*, one of the tension correcting devices, for example, the device 9*b* for preventing tension exceeding the upper limit TM in the web, leaves its stop, opening a switch 26*b*. This switch is connected in series to another switch 27*b*, which is actuated by the device 10*b* and is also closed when this device is at rest. The two switches 26*b* and 27*b* are connected in series to a counter 28 of the control unit which determines a period of time equal to a proportional function of the time constant (coresponds to the time taken by an element of web to pass from the printing device A to the printing device B). In the same way, two other switches 26*c* and 27*c* are associated with the correcting devices 9*c* and 10*c* respectively, and are connected in series to the counter 28**.

Consequently, when at the time $t_1$ the support of the correcting device **9*b* returns to its stop, it closes the electrical switch 26*b* and thus informs the control device 8** of the start of the exponential transitory conditions of variation of the tension in the web.

From the moment $t_1$, the counter 28 defines a moment $t_2$, such that $t_2-t_1=k\tau$. This moment $t_2$ corresponds to the return to the equilibrium of the web which is between the printing units A and B.

The counter 28 acts on the blocking circuit 23 to block or suppress, from the moment $t_2$, the signal given to the two gates 24 and 25. Consequently, from the moment $t_2$, the calculator or control device registers the various pieces of information proceeding from the reading units **7*b* and 7*c*. The gates 24 and 25 are connected to stores or memories 29 and 30** respectively, in which pieces of information read in cyclically are added.

The calculator or control device 8 comprises in other respects a counter 31 with a base N, N corresponding to a predetermined number of rotations of the printing cylinders. This number N is programmable and is determined by experience. It can, for example, be equal to 20. This counter 31 with a base N is connected to the counter 28 so as to be set in operation when the latter emits its output signal at the moment $t_2$.

The counter 31 thus determines a moment $t_3$, such that between the moments $t_3$ and $t_2$, the printing cylinders have carried out N rotations. Consequently, at the moment $t_3$, N pieces of information from reading units **7*b* and 7*c* have reached each of the stores 29 and 30** respectively. These pieces of information correspond to possible errors in registration.

At the moment $t_3$, the counter 31 therefore emits an output signal which is given to the various stores 29 and 30 in order to read their contents. The contents of these stores are given to dividers N32 and N33 respectively, which thus calculate the mean value of the errors previously held in the stores 29 and 30 and deliver at their output correction signals $x_2$ and $x_3$ respectively, corresponding to the mean value of these errors. The divider 32 gives the correction signal $x_2$ to the motor **3*b* of the compensating device 1*b*, in order to carry out the compensation. This signal controls, by the intermediary of the blocking circuit 23, closure of the gates 24 and 25 and the suspension of the memorization of pieces of information read by the units 7*b* and 7*c*** until the web recovers its equilibrium tension.

Naturally, if the amplitude of the compensation is small and does not produce the movement of one of the correcting devices such as **9*b* and 10*b***, the time $t_1$ is nil but the sequence of the process is the same.

Compensation for errors in registration by using a registering or length compensating device in a machine printing in more than two colours has a disadvantage in relation to compensation by differential cylinder adjustment.

In fact, when correction of the registration errors is carried out by differential cylinder adjustment the corrections can be effected in an independent manner for the various printing units, since the differential produces a variation in the angular clamping of the printing cylinder and does not modify in any way the length of the web between two successive printing units. On the other hand, the adjustments associated with the various printing units influence one another in a case where correction of the registration errors is carried out by means of length variation. In fact, if the reading unit 7b detects a registration error, the electronic control unit 8 gives the device 1b a signal to fix the printing of the printing unit B correctly in relation to that of the unit A. Because of this, the length of the web between the units A and B will be varied, but similarly, that between the units A and C. Consequently, registration carried out by the third appliance C can be destroyed in relation to the printing carried out by the unit A.

In order to compensate for this disadvantage, the control device 8 comprises a correction module 34 which is associated with each of the n-2 printing units, other than the two first ones, of a printing machine with n printing units. This correction module 34 is connected to the motor 3c of the compensating device 1c controlling the variation of the length of the web between the printing units B and C. This correction module 34 is connected on the one hand, to the output of the divider 32 which delivers the signal $x_2$ and on the other hand, to that of the divider 33 which delivers the signal $x_3$ and it makes the difference between the signals $x_3$ and $x_2$.

If $x_3=0$ is considered for the moment, it will be seen that the correction module 34 delivers a signal $-x_2$ to the motor 3c when the divider 32 applies the signal $x_2$ to the motor 3b. Because of this, the compensating device 1c moves in an opposite direction to that of the device 1b, and by the same length, in order to cancel at the level of the third printing unit C, the modification in length of the web introduced by the first device 1b.

If, following the pieces of information provided by the reading unit 7c, the control device 8 determines that it is necessary to give the device 1c a correction signal $x_3$, independently of the possible correction having to be carried out above, the correction module 34 delivers at its output a difference signal $x_3$-$x_2$ which is given to the motor 3c and which therefore takes account of the possible correction signal $x_2$ given to the motor 3b. *Thus, the correction module which develops an output* $x_3$-$x_2$ is a subtractor.

An embodiment of the invention, in which only a single movable correction device is used, will now be described with reference to FIGS. 5 to 8.

The device shown in FIGS. 5 to 8 comprises a tension correction unit 41 made up of a horizontal roll 42, rotatably mounted on a support 43. The web 4, whose tension must be controlled, passes under the roll 42, surrounding it over approximately 180° of its circumference in such a way that this roll contributes to the control of the tension of the cloth. The support 43 of the roll 42, which is represented diagrammatically by two parallel arms carrying at one of their extremities the roll 42, is mounted so as to pivot about a horizontal axis. To this end, the two arms of the support 43 are joined at their ends opposite the roll 42 by a horizontal shaft 44 which is parallel to the roll 42. This shaft 44 projects beyond one of the arms and at its end is joined to a radial arm 45. Parallel to the arm 45 and loosely mounted so as to rotate freely on the shaft 44 is another arm 46 which carries a finger 47 extending above the arm 45. The free arm 46 and the finger 47 thus constitute a movable stop below which the arm 45 which is fixed to or fast with the shaft 44 is supported.

This movable stop 46 and 47 is held against a fixed stop 48 under the action of a constant predetermined force directed downwards, which can be exerted, for example, by a spring 49. Contacts 51 and 52 of any known types, are arranged in the immediate proximity of or against the arms 46 and 45, in order to detect immediately the movement of these arms from their equilibrium position upwards and downwards, respectively.

The operation of the device which has just been described is as follows:

The device 41 determines by itself the lower tension limit Tm, below which the tension of the web 4 must not fall. This limit is determined by the weight of the movable gear, that is to say, essentially the roll 42 and its support 43, when the weight is totally exerted on the web 4.

The upper tension limit TM, above which the tension of the web must not rise, is determined by the weight of the roll 42 and its support 43, added to the constant predetermined force produced by the spring 49.

Figure 5:
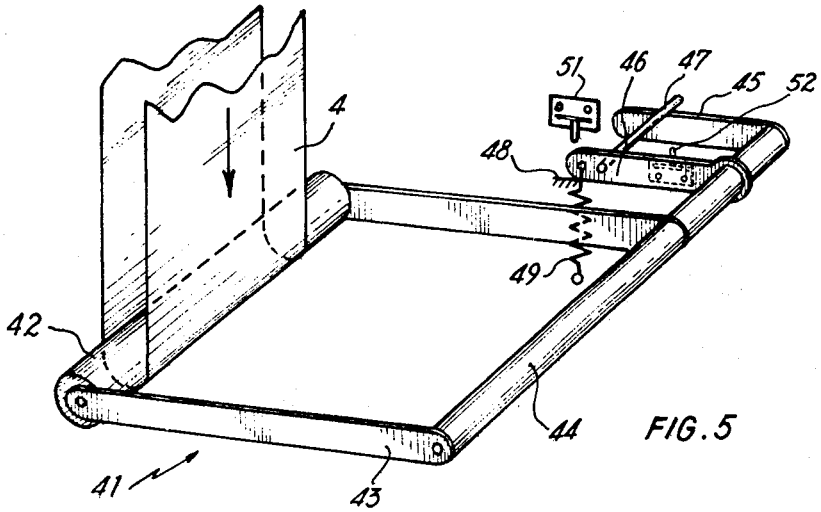
FIG. 5 is a diagrammatic perspective view of a detail of a machine embodying the invention.

Whilst the tension T of the web 4 remains between the values Tm and TM, the device 41 remains in the equilibrium position and its various constituent elements are in the positions shown in FIG. 5. In other words, the arm 45 is supported below the movable stop 46 and 47, which is itself brought back to the fixed stop 48 by the spring 49.

If the tension of the web 4 tends to fall below the lower limit Tm, the roll 42 tends to descend, bringing about a downward pivoting of the arm 45. The latter then leaves the movable stop and the entire force due to the weight of the roll and the support 43 is exerted on the web 4, thus limiting the tension in the latter to the value corresponding to the weight of the roll 42 and the support 43.

As soon as the arm 45 leaves its equilibrium position, it actuates the contact 52, which then emits a signal for the electronic adjusting device, this signal indicating that the lower threshold Tm has been reached.

If the tension of the web 4 tends to exceed the upper limit TM, the force then exerted by the lever 45 below the movable stop 46 and 47 is sufficient to separate the arm 46 from the fixed stop 48, counter to the close spiral spring 49. This spring then exerts a constant force which is directed downwards onto the arm 46, and this force is added to the weight of the roll 42 and the support 43 in order to determine the upper tension limit TM. As soon as the arm 46 leaves the stop 48, it actuates the contact 51, which emits a signal which is transmitted to the electronic adjusting device.

Figure 6:
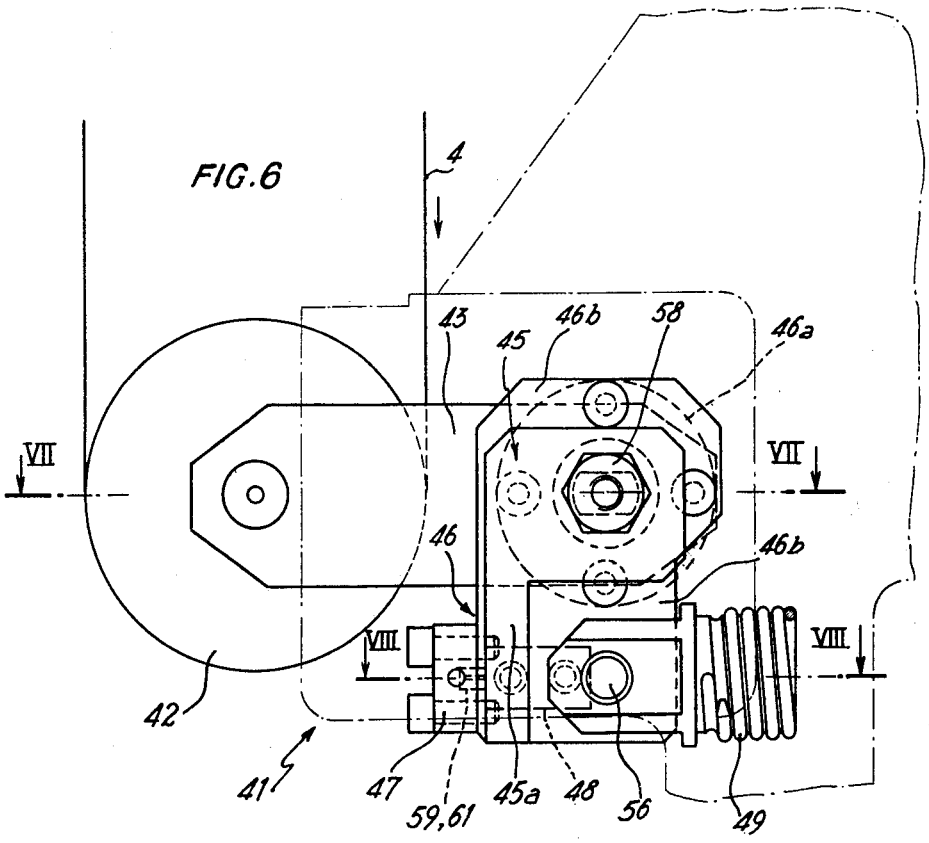
FIG. 6 is a side view, to a larger scale, of a detail of a modified machine embodying the invention.
Figure 7:
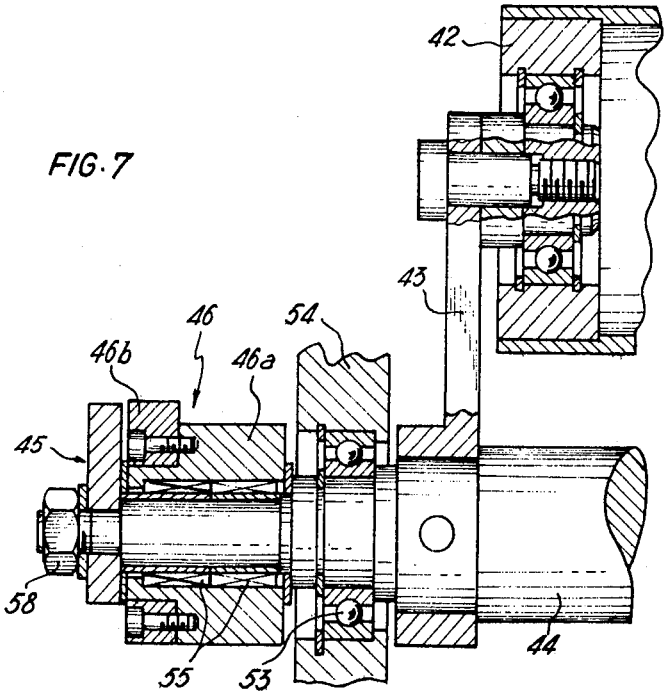
FIG. 7 is a section taken on the line VII in FIG. 6.
Figure 8:
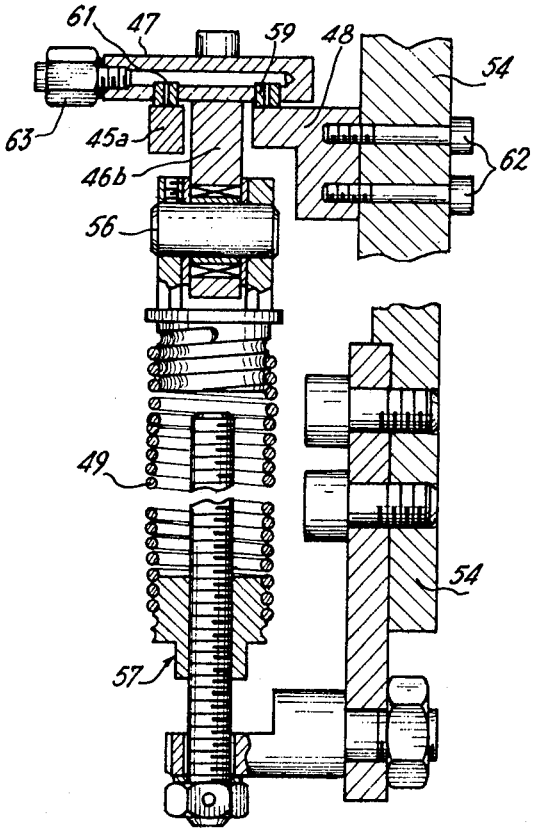
FIG. 8 is a section taken on the line VIII in FIG. 6.

In FIGS. 6 to 8 there is represented a specific embodiment of the device of FIG. 5, and in these figures the same reference numbers apply to the same constituent elements as those in FIG. 5. It can be seen in these figures that the roll 42 is carried by two radial arms 43, only one of which is represented, these arms being fixed to or fast with the shaft 44 which swivels in a frame 54, through the intermediary of a carriage 53. On the out-side of the frame 54, the shaft 44 carries a loose lever 46 which is composed of a hub 46*a* rotatably mounted on the extreme part of the shaft 44, through the intermediary of carriages 55 and by a guide plate 46*b* which is fixed to the front face of a hub 46 and extends downwards. On the lower part of the guide plate 46*b* there is attached through the intermediary of an axle 56, one extremity of the spring 49, whose other extremity is connected to the frame 54 through the intermediary of a mechanism 57 for adjusting the tension of the spring 49.

On the extremity of the shaft 44 there is fixed, by means of a nut 58, the arm 45, which has a branch 45*a* extending downwards. The guide plate 46*b* of the arm 46 carries a horizontal bar 47 which makes up the finger of the movable stop illustrated in FIG. 5. This bar 47 is hollow and it carries two noses 59 and 61, which are in contact with the fixed stop 48 fixed to the frame 54 by means of screws 62, and with the branch 45*a* of the arm 45 respectively. The noses 59 and 61 are in communication, through the inside of the hollow bar 47, with a source of fluid under pressure which is connected to the bar by a coupling 63.

Thus, when the tension in the web tends to fall below the lower limit Tm, the branch 45*a* of the arm 45 tends to move from the nose 61, which is expressed by a fall in pressure and the emission of a pneumatic signal.

Similarly, if the tension of the web tends to rise above the upper limit TM, the arm 45 acts, through its branch 45*a* on the transverse bar 47 to push it away and make the loose arm 46 pivot in a clockwise direction in FIG. 6. This is expressed by the fact that the other nose 59 moves from the fixed stop 48, in such a way that there again, a pneumatic signal is emitted.

Naturally, one could use any other type of contact to detect the movement of the movable elements.

Although in the preceding, a device in which the roll 42 of the correcting device is mounted on a support 43 which pivots has been described, it goes without saying that the invention can likewise be used with a support which slides vertically. In this case, the cylinder support would be supported directly, by means of an extension, under a movable stop which is itself brought back to a fixed stop by a spring or a pneumatic or hydraulic ram.

What is claimed is:

1. In a multi-color printing machine including a series of printing units through which a web successively passes for successively printing on the web with different colors, a system for maintaining printing of different colors on the web in registration, comprising: compensating means responsive to a control signal for adjusting the relative position of the web and one of said printing units to compensate for registration error between printing by said one printing unit and printing by another printing unit; means for detecting the registration error and for applying the control signal to said compensating means in response to the detected registration error to operate said compensating means to compensate for the detected registration error; and tension limiting means effective for limiting a tension in the web to an upper tension limit and a lower tension limit when the tension in the web tends to exceed these limits, said tension limiting means comprising a horizontal roll movable in a vertical direction with the web passing under the roll, a support mounting said roll for rotation thereon and movable in a vertical direction with said roll, means defining a movable stop having a lower position and movable in an upward vertical direction when an upwardly directed force exceeding a certain value is applied thereto for engaging said support when said support is moved vertically upwardly with said roll by the web having an increasing tension tending to exceed the upper tension limit to maintain the web tension at the upper tension limit, and means defining a fixed stop for engaging said movable stop at its lower position to allow said support to disengage from said movable stop when said support moves below the lower position of said movable stop as said roll and said support together drop vertically as the tension in the web tends to decrease below the lower tension limit to maintain the tension at the lower limit determined by the weight of said roll and said support bearing on the web beneath said roll.

2. In a multi-color printing machine according to claim 1, wherein said support includes a horizontal shaft spaced from said roll, and a pair of support arms fixed to said shaft and extending generally parallel therefrom and mounting said roll for rotation between respective ends of said support arms remote from said shaft; said shaft having a first radial arm fixed thereto which rotates upon rotation of said shaft; and wherein said movable stop is comprised of a second radial arm extending from said shaft proximate said first radial arm and mounted on said shaft for rotating thereabout, a transverse bar extending from said second radial arm for engaging said first radial arm so that rotation of said shaft to rotate said first radial arm above a certain vertical position set by said fixed stop is effective to raise said second radial arm, and a spring downwardly biasing said second radial arm.

3. In a multi-color printing machine according to claim 2, a first proximity switch coactive with said first radial arm for switching when said first radial arm moves downward, and a second proximity switch coactive with said second radial arm for switching when said second radial arm moves upward.

4. In a multi-color printing machine according to claim 2, wherein said transverse bar is comprised of a hollow transverse bar mounted on said second radial arm and having a first nose mounted on one end for engaging said fixed stop and a second nose mounted on a second end for engaging said first radial arm, and wherein fluid supplied through said hollow transverse bar under pressure develops pneumatic signals for indicating positions of said first nose and said second nose.

* * * * *